United States Patent [19]

Mose et al.

[11] 4,263,119

[45] Apr. 21, 1981

[54] ANODE ELEMENTS FOR MONOPOLAR FILTER PRESS ELECTROLYSIS CELLS

[75] Inventors: Luciano Mose, Dortmund; Helmut Schurig, Holzwickede; Bernd Strasser, Hamm, all of Fed. Rep. of Germany

[73] Assignee: Hooker Chemicals & Plastics Corp., Niagara Falls, N.Y.

[21] Appl. No.: 39,988

[22] Filed: May 17, 1979

[30] Foreign Application Priority Data

May 19, 1978 [DE] Fed. Rep. of Germany ..... 2821978

[51] Int. Cl.[3] ..... C25B 9/00; C25B 11/03; C25B 15/08

[52] U.S. Cl. ..... 204/257; 204/283; 204/295; 204/263

[58] Field of Search ..... 204/257-258, 204/263-266, 269-270, 282-283, 284

[56] References Cited

U.S. PATENT DOCUMENTS

| | | | |
|---|---|---|---|
| 1,963,959 | 6/1934 | Enzor | 204/258 |
| 2,691,628 | 10/1954 | Aannerud | 204/258 X |
| 3,790,465 | 2/1974 | Giacopelli et al. | 204/258 |
| 3,930,151 | 12/1975 | Shibata et al. | 204/258 |
| 4,118,306 | 10/1978 | De Nora et al. | 204/283 X |
| 4,177,116 | 12/1979 | De Nora et al. | 204/283 X |

*Primary Examiner*—G. L. Kaplan
*Assistant Examiner*—D. R. Valentine
*Attorney, Agent, or Firm*—Peter F. Casella; William G. Gosz

[57] ABSTRACT

An improved anode element for monopolar filter-press electrolysis cells comprises providing said anode element with an integral hollow member positioned above the upper surface of said anode element. Preferably, said hollow member is formed as an integral extension of the electrode frame, said hollow member having an outlet for withdrawing chlorine gas and being adapted to permit continuous fluid contact with said anode element, said hollow member being further adapted to provide sufficient hydrostatic pressure in said anode element for optimal liquid flow through the diaphragm over the entire operating cycle of the electrolysis cell.

3 Claims, 2 Drawing Figures

ANODE ELEMENTS FOR MONOPOLAR FILTER PRESS ELECTROLYSIS CELLS

BACKGROUND OF THE INVENTION

This invention pertains to an anode element for monopolar electrolysis cells arranged in a filter-press type configuration, and especially to those filter-press type cells operated according to the diaphragm process.

Electrolysis cells of this type are used primarily for chlor-alkali electrolysis, which comprises the preparation of chlorine, hydrogen, and alkali hydroxides from aqueous alkali chloride solutions by electrochemical action. Chlorine is also obtained as a by-product of the electrolysis of molten salts used in the manufacture of alkali metals or alkaline earth metals. Cells of this type have also been increasingly used in the electrolytic decomposition of hydrochloric acid, and are becoming more significant in this respect.

Some of these products are produced in very large quantities as basic chemicals. In the case of chlor-alkali electrolysis, plants are frequently operated with individual process loop production capacities of 500 to 1000 tons of chlorine per day. In such plants, current intensities of up to about 500,000 amps are attained. Depending upon the particular process used, larger or smaller numbers of electrolysis cells may be combined into a single circuit.

If an electrical direct current is caused to flow through an electrochemical cell having an alkali chloride-containing aqueous electrolyte, chlorine gas is primarily formed at the positive pole or anode, while hydrogen gas and alkali hydroxide are formed at the negative pole or cathode. Reverse reaction due to mixing of the products should, of course, be prevented. For this purpose, at first two different processes were initially developed: the so-called mercury process and the diaphragm process.

When the diaphragm process is employed in chlor-alkali electrolysis, alkali chloride solution is typically fed into the anode chamber and chlorine is removed at the anode. The alkali ions, together with the remaining depleted alkali chloride solution, migrate through the diaphragm into the cathode chamber. There, the alkali ions are discharged at the cathode where alkali hydroxide and hydrogen form in the presence of water. Thus, a mixture of alkali chloride and alkali hydroxide forms, the so-called cell liquor, which is further processed in order to obtain purified hydroxide. The diaphragm, serving as a porous separating wall, separates the anode chamber from the cathode chamber and thus prevents mixing and the undesirable reverse reaction of the products separated at the electrodes.

In order to provide continuous electrolysis, a uniform liquid flow through the diaphragm into the cathode chamber should be maintained. For this purpose, various liquid levels are maintained in commercial diaphragm cells and thus different hydrostatic pressures are produced in the anode chamber and in the cathode chamber. Since the flow resistance of the diaphragm changes during the operating cycle, for example due to clogging and other similar problems, diaphragm cells currently in use are generally equipped with a characteristic high cover in which a relatively large pressure differential can be maintained. These diaphragm cells are typically designed in the shape of a trough, wherein the cathodes project like fingers into a collar. If a common anode chamber is employed for all anodes then, in the case of chlor-alkali electrolysis, chlorine gas produced at the anodes is gathered together into the high cover mentioned above.

A third electrolysis process, the so-called membrane cell process, has been increasingly used in recent times. Since dimensionally stable anodes and permselective membranes are now available, electrolysis cells can be produced with a thin separating membrane clamped between flat opposed electrodes.

A cell block having a filter-press type configuration can be obtained by joining together several individual electrolysis cells having electrode elements and partitions, such as diaphragms or permselective membranes, located between them. The filter-press type electrolysis cells are well known as shown, for example, in German Pat. No. 1,054,430 and German Offenlegungsschrift No. 2,222,637, the disclosures of which are incorporated herein by reference, illustrating the electrolysis of aqueous hydrochloric acid, and in German Offenlegungsschrift No. 2,510,396, directed to chlor-alkali electrolysis, the disclosure of which is also hereby incorporated by reference.

In general, the cell elements are held in supporting frames. With the aid of a suitable pressing device, for example a hydraulic device, a tension bar, or individual screws, the cell block is pressed together with gaskets placed between the cell elements to seal them off from one another, and subsequently mounted, if desired, on a suitable frame to form a rigid unit, which may have from about 10 up to, for example, 100 cell elements and a corresponding production capacity.

The electrolysis filter-press type cells can then be connected in bipolar or monopolar fashion in accordance with procedures such as illustrated in U.S. Pat. No. 4,056,458, the disclosure of which is hereby incorporated by reference. The monopolar electrode elements generally comprise two parallel electrode surfaces between which the cathode chamber or the anode chamber is formed, depending on the electrical connection of the electrode element. Such an arrangement is illustrated in applicant's concurrently filed patent application No. 039,997 relating to an electrolysis cell system, the disclosure of which is hereby incorporated by reference. Irrespective of the particular design employed, however, it has been found difficult to form different liquid levels without substantial loss of active electrode and diaphragm surface area.

It is thus a primary object of this invention to provide an improved anode element suitable for use in filter-press type electrolysis cells, and particularly suited for use in diaphragm cells, which will provide for improved operating efficiency.

SUMMARY OF THE INVENTION

This object is achieved in accordance with the present invention by providing an elongated, hollow member positioned directly above the anode element. This hollow member makes it possible to adjust the liquid level in the anode element such that an adequate hydrostatic pressure is achieved in the cell to maintain the necessary liquid flow through the diaphragm during the entire operating cycle of the electrolysis cell. Moreover, it is particularly advantageous that the anode element of the present invention can also be used in electrolysis cells which employ membranes as separating elements following suitable modification of the flow paths for the electrolysis media. In the case of membrane cells, the liquid level in the anode element is adjusted to the same height as the liquid level in the adjacent cathode element.

A particularly simple and advantageous design is achieved when the hollow member of the present invention is formed as an integral extension of the electrode frame. Such a design is a preferred embodiment of the present invention.

The gas formed at the anode element is advantageously withdrawn from the hollow member by means of outlet lines extending from said hollow member and opening into a common collecting line.

In order to achieve optimal process conditions, the height of the hollow member can be selected in accordance with the flow resistance of the particular diaphragm employed. Alternatively, it is also possible to adapt the diaphragm to correspond to the height of the particular hollow member employed. In accordance with a preferred embodiment of the present invention, it has been found advantageous to provide a hollow member having a vertical extension of from about 300 mm to about 800 mm when asbestos diaphragms are employed as separators. The present invention will now be explained in greater detail by reference to the attached drawings.

DETAILED DESCRIPTION OF THE PREFERRED EMBODIMENTS

Figure 1:
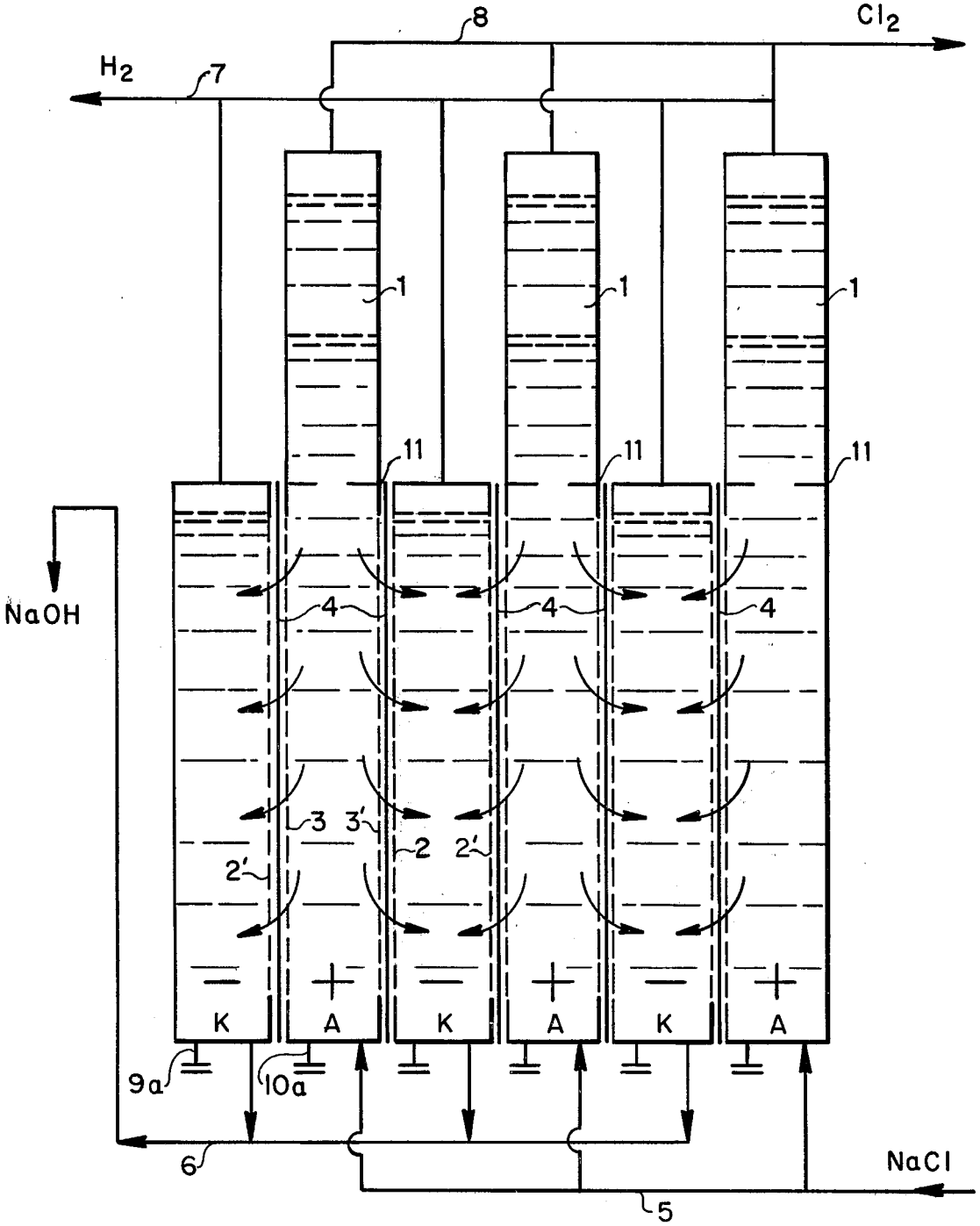
FIG. 1 is a schematic representation of an electrolytic diaphragm cell having a filter-press type configuration.

In the electrolytic diaphragm cell shown in FIG. 1, cathode and anode elements, K and A respectively, are arranged alternatively in succession. In each case, electrode elements K and A have mono-polar connections, i.e. each of the two parallel electrode surfaces 2,2' and 3,3' forms, respectively, the cathode or anode of the corresponding electrolysis cell. A diaphragm 4 is placed between the electrode surfaces, separating adjacent electrode elements and preventing back diffusion of the products separated at the electrodes.

During operation, the electrolyte, for example an aqueous NaCl solution, is circultated to the anode elements by means of connecting line 5. The cell liquor formed at the cathode elements K, which in the case of chlor-alkali electrolysis consists of a mixture of alkali chloride and alkali hydroxide, is transported by means of suitable connecting pipes at the cathode elements to collecting line 6 for hydroxide recovery. The hydrogen formed at cathode elements K and the chlorine formed at anode elements A is removed from the cell by means of collecting lines 7 and 8, respectively.

In order to maintain sufficient liquid flow into cathode element K from anode element A, as represented by the arrows in FIG. 1, a vertically extending hollow member 1 is provided surmounting anode element A, so that a higher liquid level can be established in anode element A as compared to cathode element K. As shown in FIG. 1, the diaphragm 4 only extends as far as the common interface between the cathode and anode elements, K and A respectively. In this instance, the hollow member 1 is preferably an integral component and extension of electrode frame 11, on which the electrode surfaces 3 and 3' are supported.

Diaphragm member 4 can be fabricated from a suitable cloth or microporous sheet clamped between the anode and cathode elements A and K. If the diaphragm is made of asbestos in a known manner, it can be precipitated outside the cell from a suspension of fibers and clamped in the cell as a pre-finished diaphragm in the form of a cloth or plate. In this case, the familiar immersion of the entire cathode element into the asbestos slurry can be eliminated, resulting in a considerable savings of time during cell maintenance.

Figure 2:
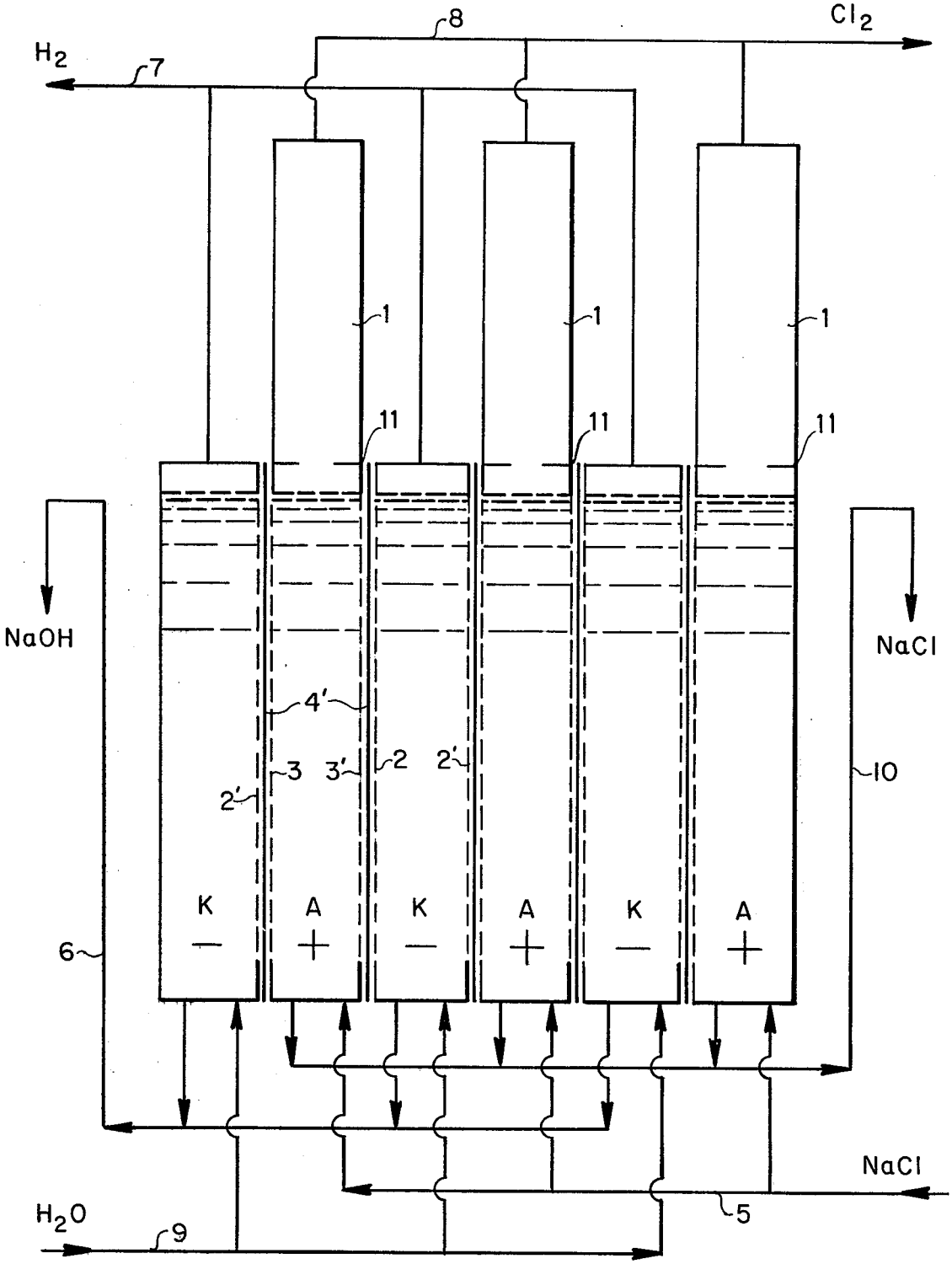
FIG. 2 is a schematic representation of an electrolytic membrane cell having a filter-press type configuration.

In accordance with the present invention, anode element A can also be employed in electrolytic membrane cells having filter-press type configurations and operated according to the membrane cell process. In this case, as shown in FIG. 2, the diaphragm member is replaced by a permselective membrane 4', and an additional collecting line 10 is attached to the anode elements to remove depleted anodic solution through opening 10*a* (see FIG. 1). Solvent, for example $H_2O$, is conveyed to cathode elements K by way of openings 9*a* (see FIG. 1) through collecting line 9 to replace the depleted anodic solution. In this mode of operation of the electrolysis cell, similar liquid levels are established in the two electrode chambers K and A, i.e., the hollow member 1 surmounting the anode element A contains substantially no electrolysis fluid. As is known to those skilled in the art, microporous membranes can be substituted or used in addition to conventional membranes.

Although the present invention has been described in terms of specific embodiments, it is to be understood that modifications and variations may be made without departing from the spirit and scope of the invention, as those of ordinary skill in the art will readily appreciate. Suitable modifications and variations are considered to be within the purview and scope of the appended claims. For instance, although the hollow member has been described in a schematic representation only, it will be appreciated that the actual shape of said hollow member is not critical to the practice of this invention. In general, as illustrated in the drawing, the external boundaries of the hollow member will preferably be substantially contiguous with the external boundaries of the anode frame. In this particular embodiment, the outer boundaries of the frame have substantially the same dimensions as the outer boundaries of the hollow member.

What is claimed is:

1. In a filter-press type chlor-alkali diaphragm cell anode, the improvement comprising an elongated hollow extension of said anode, said hollow extension being adapted to permit continuous fluid contact with said anode and having a sufficient vertical elongation substantially contiguous with the anode frame to provide additional liquid capacity above the normal liquid level in said anode for optimal liquid flow through the diaphragm.

2. The anode of claim 1 wherein a gas is withdrawn from said hollow extension.

3. The anode of claim 1 wherein an asbestos diaphragm is employed in said cell, and said hollow extension is from about 300 millimeters to about 800 millimeters in length.

* * * * *